US008297454B2

(12) United States Patent
Kolshorn et al.

(10) Patent No.: US 8,297,454 B2
(45) Date of Patent: Oct. 30, 2012

(54) ADAPTER COUPLER FOR ADAPTING COUPLINGS OF DIFFERENT DESIGN

(75) Inventors: Kay Uwe Kolshorn, Wolfenbuttel (DE); Siegfreid Kobert, Holle (DE); Dirk Behrens, Halberstadt (DE)

(73) Assignee: Voith Patent GmbH, Heidenheim (DE)

( * ) Notice: Subject to any disclaimer, the term of this patent is extended or adjusted under 35 U.S.C. 154(b) by 148 days.

(21) Appl. No.: 12/788,930

(22) Filed: May 27, 2010

(65) Prior Publication Data

US 2010/0322706 A1 Dec. 23, 2010

(30) Foreign Application Priority Data

Jun. 17, 2009 (EP) ..... 09162958

(51) Int. Cl.
*B61G 5/04* (2006.01)

(52) U.S. Cl. ..... 213/75 R

(58) Field of Classification Search ..... 213/75 R, 213/78, 82, 84, 93, 95, 98, 100 R, 175, 178
See application file for complete search history.

(56) References Cited

U.S. PATENT DOCUMENTS

| | | | | |
|---|---|---|---|---|
| 7,604,136 | B2 * | 10/2009 | Kontetzki | 213/75 R |
| 2002/0033221 | A1 * | 3/2002 | Nakamura | 156/155 |
| 2003/0057590 | A1 * | 3/2003 | Loher et al. | 264/157 |
| 2010/0255235 | A1 * | 10/2010 | Ilzhoefer et al. | 428/36.3 |

FOREIGN PATENT DOCUMENTS

| | | | |
|---|---|---|---|
| DE | 509 708 | C | 10/1930 |
| DE | 29 51 686 | A1 | 7/1981 |
| EP | 1 632 414 | A1 | 3/2006 |
| EP | 1 894 808 | A2 | 3/2008 |
| FR | 2 622 856 | A1 | 5/1989 |

OTHER PUBLICATIONS

European Search Report, European Application No. 09162958.4-2422, dated Nov. 24, 2009, 6 pages.

* cited by examiner

*Primary Examiner* — Mark Tuan Le
*Assistant Examiner* — Zachary Kuhfuss
(74) *Attorney, Agent, or Firm* — Cesari and McKenna, LLP; John F. McKenna

(57) ABSTRACT

An adapter coupler for adapting couplings of different design has a first connecting mechanism for the releasable connecting of the adapter coupler to a first coupling, a second connecting mechanism for the releasable connecting of the adapter coupler to a second coupling, and a coupler housing to connect the first connecting mechanism to the second connecting mechanism. With the objective of simplifying the manual manipulation of the adapter coupler, it is configured to be of lightweight construction, wherein the coupler housing is formed from fiber composite material, in particular carbon file composite material, and exhibits a shape adapted to an adapter coupler constructed from metal, and wherein the coupler housing exhibits a sturdy fiber architecture relative to the stress loads it experiences.

32 Claims, 8 Drawing Sheets

ADAPTER COUPLER FOR ADAPTING COUPLINGS OF DIFFERENT DESIGN

BACKGROUND OF THE INVENTION

The present invention relates to an adapter coupler for adapting couplings of different design, wherein the adapter coupler comprises a first connection zone for the releasable connecting of the adapter coupler to a first coupler, a second connection zone for the releasable connecting of the adapter coupler to a second coupler, as well as a coupler housing to connect the first connecting mechanism to the second connecting mechanism.

The invention accordingly relates to an adapter coupler to, for example, join couplings of an automatic central buffer coupling and a screw-type or AAR coupling, whereby the first connection zone can be configured as a coupling lock for the releasable connecting of the adapter coupler to the coupler head of an automatic central buffer coupling and wherein the second connection zone can be configured as a coupling yoke to fit in the drawhook of a screw-type or AAR coupling for the releasable connecting of the adapter coupler to the coupler head of a screw or AAR coupling.

The term "connection zone" as used herein is to be generally understood as an interface between the coupler housing of the adapter coupler on the one side and the coupling to be connected by the adapter coupler. The connection zone can for example be configured as a coupling lock or can comprise a coupling lock for the releasable connecting of the adapter coupler to the coupler head of an automatic central buffer coupling. On the other hand, it is conceivable for the connection zone to have a coupling yoke which can fit into the drawhook of a screw-type or AAR coupling. Of course, other embodiments of the connection zone are also feasible.

An adapter coupler of the type cited above is known in general in railway technology and is used to connect rail-borne vehicles having differing coupling systems (e.g. Scharfen-berg couplings to an AAR head or drawhook). Connecting the adapter coupler for example to the drawhook or AAR head is usually done manually, while in the case of a central buffer coupling, the coupling process can be automatic.

A conventional adapter coupler to join the couplings of an automatic central buffer coupling and, for example, a screw-type coupling usually exhibits a coupler housing for accommodating a coupling lock as the first connecting mechanism for mechanically connecting the adapter coupler to a coupling lock provided in the coupler head of the automatic central buffer coupling. In the coupled state, the front face of the coupler housing then butts against the adapter coupler at the front face of the automatic central buffer coupling's coupler head.

A coupling yoke can be provided as a second connecting mechanism on the end opposite the front face of the adapter coupler which can be received, for example, in the draw-hook of a screw-type coupling or an AAR coupling and thus provide a mechanical connection of the adapter coupler to the screw-type or AAR coupling.

In operation, tension and compression loads are introduced into the second connecting mechanism of the adapter coupler configured as a coupling yoke from the drawhook of the screw-type or AAR coupling. The compressive load introduced into the coupling yoke, second connecting mechanism respectively, is conducted through the wall of the coupler housing to the front face of the adapter coupler and from there, transmitted to the front face of the automatic central buffer coupling's coupler head mechanically connected to the adapter coupler.

Tractive load, on the other hand, is transmitted through the first connecting mechanism such as the mechanically connected coupling locks of the adapter coupler and the automatic central buffer coupling. The coupling locks can for example comprise a core piece pivotably mounted relative the coupler housing by means of a main pin and having a coupling grommet attached thereto. Tractive forces are thereby transmitted via the respective coupling grommets which engage in the corresponding core pieces.

It is to be noted at this point that the present invention is by no means limited to an adapter coupler designed to connect an automatic central buffer coupling to a screw-type coupling. Rather, the invention relates in general to an adapter coupler for adapting couplings of differing design, whereby the adapter coupler comprises a connecting mechanism which is compatible with a coupling of a first design type and configured to form a releasable connection to the coupling of the first design type, and whereby the adapter coupler further comprises a second connecting mechanism which is compatible with a coupling of a second design type and configured to form a releasable connection to the coupling of the second design type.

Since the first and second connecting mechanisms are respectively connected together via the coupler housing in generic adapter couplers, the tension and compression loads which occur during operation are—when the adapter coupler is used to adapt the coupling of the first design type to the coupling of the second design type—transmitted from the first connecting mechanism to the second connecting mechanism via the coupler housing.

Since the housing of the adapter coupler is thus involved in the transmission of force in the case of both tractive as well as compressive loads, it needs to exhibit correspondingly high compressive and tensile strength. For this reason, the coupler housing provided in a conventional adapter coupler is usually realized as a metal construction (precision cast), thus using a material which exhibits comparatively high tensile and compressive strength and in particular has isotropic properties, i.e. physically uniform in all directions.

The disadvantage of a conventional adapter coupler as known in rail technology and described above can be seen in that the metal construction, in particular to the coupler housing, makes it difficult to manually fit the adapter coupler into the interface between the couplings to be adapted, for example the drawhook of a screw-type or AAR coupling.

It has therefore been long endeavored to design an adapter coupler of lightweight construction allowing easier manual manipulation.

SUMMARY OF THE INVENTION

The present invention is based on the problem that the previous approaches to realizing a lightweight construction in the design of a coupler housing for an adapter coupler are not applicable or not so readily applicable. This is due to, on the one hand, there only being a defined limited space available for the adapter coupler such that the geometric dimensions to an adapter coupler of lightweight construction have to essentially correspond to the dimensions of a conventional adapter coupler. On the other hand, an adapter coupler is a relatively heavily stressed component situated within the flow of forces, subject not only to compressive load but also, and in particular, tractive load. For this reason, aluminum, for example, cannot be used as the material for the coupler housing of the adapter coupler because aluminum has only comparatively low tensile strength.

Based on this problem, the present invention addresses the task of designing an adapter coupler of the type cited at the outset in a lightweight construction so as to simplify in particular its manual manipulation.

This task is solved on the one hand by designing the coupler housing from a fiber composite material, in particular a carbon fiber composite material, and in a shape adapted to the geometry of a coupler housing constructed from metal.

On the other hand, the invention provides for the coupler housing to have a sturdy fiber architecture relative the stress loads it experiences.

In one possible realization of the inventive solution with respect to the introduction of tractive and compressive forces, it is additionally conceivable for the first and/or second connecting mechanism to be designed as an insert and accommodated in a recess within the coupler housing and fixedly connected to said coupler housing.

To be generally understood by the term "insert" as used herein is an insert which serves to ensure that force is not applied directly to the fibers of the fiber composite material at that point where the tractive and compressive forces are introduced into the adapter coupler. Rather, force is not applied to the fibers of the fiber composite material until after the force introduced into the adapter coupler has been transmitted through the insert and thus fanned out. This prevents force peaks from acting on the fibers of the fiber composite material.

Fiber reinforced plastics are structurally based on reinforcing fibers embedded in polymer matrix systems. By the matrix holding the fibers in a predetermined position, transmitting tension between the fibers and protecting the fibers from external influences, the reinforcing fibers are accorded load-bearing mechanical properties. Aramid, glass and carbon fibers are particularly well-suited as reinforcing fibers. Since because of their elasticity, aramid fibers only have low rigidity, glass and carbon fibers are used in rigid structural components. Because they exhibit the highest specific strength, carbon fibers are used exclusively for components subject to heavy loads, such as the coupler housing of an adapter coupler.

While it is known, for instance in aerospace technology, that carbon fiber reinforced plastics (CFP) have a high specific rigidity and strength and can thereby be attractive for structural or load-bearing structures, what remains problematic is that the mechanical properties of carbon fiber reinforced plastics are anisotropic; i.e. directionally dependent. Depending on the type of fiber, the tensile strength transverse to the fiber direction amounts in each case to only about 5% of the tensile strength in the fiber direction. Therefore, at first glance, a coupler housing constructed from a fiber composite would appear unsuitable for use with an adapter coupler.

In the case of the present invention, it is known that a certain fiber architecture needs to be realized in constructing the coupler housing of the adapter coupler in order to maintain the properties adapted to the expected loading conditions. Specifically, the invention proposes using a carbon fiber reinforced plastic as the material for the coupler housing wherein at least the majority of the fibers are run in the direction of the previously-calculated load path. A quasi-isotopic fiber architecture of identical magnitude in different spatial directions may be selected for specific sections as needed when these sections are subjected to loads coming from different directions.

Furthermore, the external form of the coupler housing draws on that of a coupler housing of metal construction, wherein, however, sharp-edged bends, crimps and any stiffening ribs there may be, which are easily realized when precision casting and make sense from a mechanical standpoint, are preferably consciously avoided, Because the inventive coupler housing made from fiber composite material exhibits a shape adapted to a coupler housing of metal construction and is preferably rounded, abrupt changes to the fiber orientation aligned to the force flux vectors, which would lead to a notching effect on the fibers and a structural failure, can be effectively prevented in virtually identical construction spaces.

Due to the fact that the coupler housing of the adapter coupler exhibits a comparatively complex three-dimensional geometry, using processes known from the prior art to produce composite materials is problematic. Since, as noted above, the fibers of the coupler housing of the inventive adapter coupler are designed to resist the stress loads to which they're subjected; i.e. run near net-shaped along the precalculated force flux vectors, the fibers frequently need to change their distance from one another because the lines of flux converge at points of constriction, respectively the areas at which tractive and compressive loads are introduced into the coupler housing via the first and/or second connecting mechanism. Since, however, the fibers require an unchanging space, they cannot be densely positioned at will. Rather, the number of fibers needs to be reduced at points of constriction, respectively in heavily-stressed areas. In such cases; i.e. heavily-stressed areas of the coupler housing, gaps then develop along the positioning path of the fibers which can have a negative impact on the mechanical behavior of the composite material in these heavily-stressed areas.

To avoid this, one preferred realization of the inventive solution provides, with respect to introducing the tractive and compressive forces transmitted to the coupler housing via the first and/or second connecting mechanism, for the first and/or second connecting mechanism to be designed as an insert, for example a metal or ceramic insert, accommodated in the coupler housing, and fixedly connected to said coupler housing. Force is accordingly introduced into the fibers of the fiber composite material, not directly to the area where the tension and compression loads are introduced into the adapter coupler. Here, force is not introduced into the fibers of the fiber composite material until after the force introduced into the adapter coupler is transmitted through the connecting mechanism configured as an insert and thus fanned out. Doing so prevents force peaks from acting on the fibers of the fiber composite material.

It is thus to be maintained that, due to the special construction of the coupler housing, it is possible to use fiber composite materials, whereby a maximum weight advantage relative metal constructions along with the same specific strength and rigidity can be achieved also in the case of a highly-stressed coupler housing.

Further advantageous embodiments of the inventive adapter coupler are indicated in the dependent claims.

As indicated above, one preferred realization of the inventive solution provides for, with respect to the introducing of the tractive and compressive forces transmitted via the first and/or second connecting mechanism into the coupler housing, configuring said first and/or second connecting mechanism as an insert, for example a metal insert, accommodating it in the coupler housing and fixedly connecting it to said coupler housing. Force is accordingly introduced into the fibers of the fiber composite material, not directly to the area where tension and compression loads are introduced into the adapter coupler. Here, force is not introduced into the fibers of the fiber composite material until after the force introduced into the adapter coupler is transmitted through the connecting mechanism configured as an insert and thus fanned out. Doing so prevents force peaks from acting on the fibers of the fiber composite material.

On the other hand, it is preferred for the coupler housing to exhibit a specific fiber architecture which deflects compressive load introduced into the coupler housing via the first connecting mechanism and/or the second connecting mechanism such that at least a portion thereof is absorbed by the carbon fiber reinforced material as traction load.

Alternatively or additionally hereto, it is conceivable for the coupler housing to comprise tension or compression fiber areas which are spatially separated from one another, at least sectionally, and integrated into the carbon fiber composite material, whereby the tractive forces introduced into the coupler housing via the first and/or second connecting mechanism are essentially absorbed by the tension fiber area and the compressive forces introduced into the coupler housing by the first and/or second connecting mechanism are essentially absorbed by the compression fiber area.

By the coupler housing being constructed in a specific fiber architecture able to withstand stress, the inventive solution achieves a spatial separation of the compressive and tractive loading paths resistant to the stresses to which they're subjected. The specific load on the coupler housing in which compressive and tractive load have completely different loading regions is hereby used. Commensurate with these load paths, special tension and com-pression fiber strands are integrated in the latter cited realization of the inventive solution.

One possible realization of the inventive solution in which the first connecting mechanism has a coupling lock for the releasable connecting of the adapter coupler to the coupler head of a central buffer coupling and in which the second connecting mechanism has a coupling yoke insertable into the drawhook of a screw-type or AAR coupling for the releasable connecting of the adapter coupler to the coupler head of a screw-type or AAR coupling provides for the previously-cited compression fiber area to be configured as a compression chord integrated in the carbon fiber composite material, which runs from the train-side front face of the coupler housing to an area of the coupling yoke receiving compressive load, and the previously-cited tension fiber area is configured as a traction chord integrated in the carbon fiber composite material which connects a main pin of the coupling lock with an area of the coupling yoke receiving tensile load.

This spatial separation of the compression and traction load paths, respectively the areas of the coupler head receiving compressive force and tensile force, is extremely unusual, since tractive and compressive loads usually take the same paths. Consciously selecting a spatial separation of the compression and traction load paths can effectively prevent the CFP structure of the coupler head from having to absorb both loads equally. Spatially separating the areas of the coupler head CFP structure receiving compressive force and tensile force as proposed by the inventive solution allows better use of the CFP material.

On the other hand, it is in principle conceivable for the coupler housing to be designed with a conical or funnel-shaped profile to its horizontal longitudinal section on its tapered end and configured with a recess extending the longitudinal axis of the adapter coupler, wherein a coupling yoke configured as an insert is received in said recess and fixedly connected to the coupler housing. Thus a profile is proposed for the coupler housing which is adapted to a coupler head of an automatic central buffer coupling, in particular the coupler head of an automatic central buffer coupling of the Scharfenberg® type, which aligns the coupler head of the automatic central buffer coupling, centers it, and guarantees an automatic connection of the adapter coupler to the coupler head of the automatic central buffer coupling even in tight curves and upon height displacements.

The coupling yoke configured as an insert being received in a recess configured in the tapered end of the coupler housing and fixedly connected to said coupler housing ensures that the forces transmitted from a drawhook of a screw-type coupling to the coupling yoke can be introduced laterally into the material of the coupler housing and in particular to the fibers aligned along the previously-calculated force flow path.

It is in particular preferred for the recess provided at the tapered end of the coupler housing to exhibit a U-shaped cross-sectional form with rounded edges in longitudinal section. This enables effectively preventing bends in the force flux vectors at the transition between the coupling yoke configured as an insert and the aligned fibers of the fiber composite coupler housing, which would lead to a notching effect on the fibers and a structural failure.

One preferred realization of the adapter coupler of the above described embodiment provides for the coupling yoke configured as an insert to exhibit a U-shaped cross-sectional geometry in longitudinal section, whereby a drawhook pin is further provided to connect the two limb sections of the U-shaped coupling yoke together and is designed to transmit tractive or compressive forces from the drawhook of a screw-type or AAR coupling to the coupling yoke configured as an insert. Conceivable in this respect is in particular realizing the drawhook pin separately from the coupling yoke configured as an insert and accommodated in axial alignment in drill holes provided in the two limb sections of the coupling yoke.

In order to obtain a connection between the coupling yoke configured as an insert and the fiber composite coupler housing which is as stable as possible, one preferred realization of the adapter coupler provides for the coupling yoke configured as an insert to comprise sleeve-shaped elements axially aligned with the drill holes configured in the limb sections of the coupling yoke. These sleeve-shaped elements are in turn received in drill holes running though the coupler housing. The coupling yoke configured as an insert is thus not only force-fit connected to the coupler housing, but also form-fit.

It is thereby preferably provided for the drawhook pin of the coupling yoke to run through the sleeve-shaped elements of the coupling yoke on the one side and, on the other, through the drill holes provided in the coupler housing and axially aligned with the sleeve-shaped elements of the coupling yoke. This enables the drawhook pin to be replaced—if necessary—without having to disengage the coupling yoke configured as an insert from the fiber composite coupler housing.

In the latter embodiment of the inventive adapter coupler, it is of particular advantage for the peripheral region of the drill hole running through the coupler housing to be con-figured as a thickened section. Since the peripheral region of this drill hole contributes to that which is introduced from the drawhook pin to the fiber composite coupler housing, the thickened section increases the tensile and compressive strength of the fiber architecture provided in this area of the coupler housing.

The adapter coupler is preferably designed for mixed-use coupling between an automatic central buffer coupling of the Scharfenberg® type and a screw-type coupling. In this case, the coupling lock of the adapter coupler comprises a core piece with attached coupling grommet pivotable relative the coupler housing by means of a vertically-extending main pin. Since at least the tractive forces which are transmitted from an automatic central buffer coupling connected to the adapter coupler to said adapter coupler are then transmitted via the core piece and the main pin in the fiber composite coupler housing, it is preferred for the upper and/or lower end section of the main pin to be mounted in a sleeve-shaped element configured as an insert provided in a base body and set into a drill hole extending in the longitudinal direction of the main pin and fixedly connected to the base body. The transmission of force in the fiber composite coupler housing in this preferred realization of the adapter coupler thus does not occur directly via the main pin, but rather indirectly via the sleeve-shaped element, such that the forces introduced can be laterally distributed to the fibers of the fiber composite coupler housing. This effectively prevents structural failure of the fiber composite coupler housing in the vicinity of the main pin.

It is in principle preferred for the fiber composite base body to be integrally formed as a winding body made from carbon fibers in the form of continuous fibers. Lending itself well to the manufacture of the coupler housing is the so-called Tailored Fiber Placement (TFP) process in which fibers are fixed by means of stitching to flat substrates such as for example glass or carbon fiber textile material. Fixing can be effected using different sewing thread materials. While e.g. polyester threads can contribute to the strength of the later CFP material, aramid, glass or carbon threads can improve the interlaminar shear strength. It is also in principle possible to utilize fusible threads which melt during the infiltration phase. The fix-stitched fibers thereby relax, achieving a homogenous fiber structure.

It is however of course also conceivable to chose the so-called prepreg process to manu-facture the fiber composite coupler housing. The prepreg process starts with thin fiber strands of parallel continuous filaments pre-impregnated with a viscous polymer resin. The prepegs are provided with separating papers or films on both sides and are processed from rolls. The material is cut and then structured in layers according to a layout plan.

Since the prepreg process is particularly suited to relatively large and slightly curved components and not complex three-dimensional constructions, it is preferable to make use of the so-called infiltration process in the manufacturing of the coupler housing employed in the inventive adapter coupler. This entails first processing a "dry," i.e. resin-free, semi-finished carbon fiber product into a preform and it later being infiltrated by low-viscosity polymer resin.

The following will reference the accompanying drawings in describing preferred embodiments of the adapter coupler according to the invention

BRIEF DESCRIPTION OF THE DRAWINGS

Shown are:

FIG. 4;

FIG. 4;

FIG. 4;

FIG. 4;

DESCRIPTION OF THE PREFERRED EMBODIMENT

Figure 1:
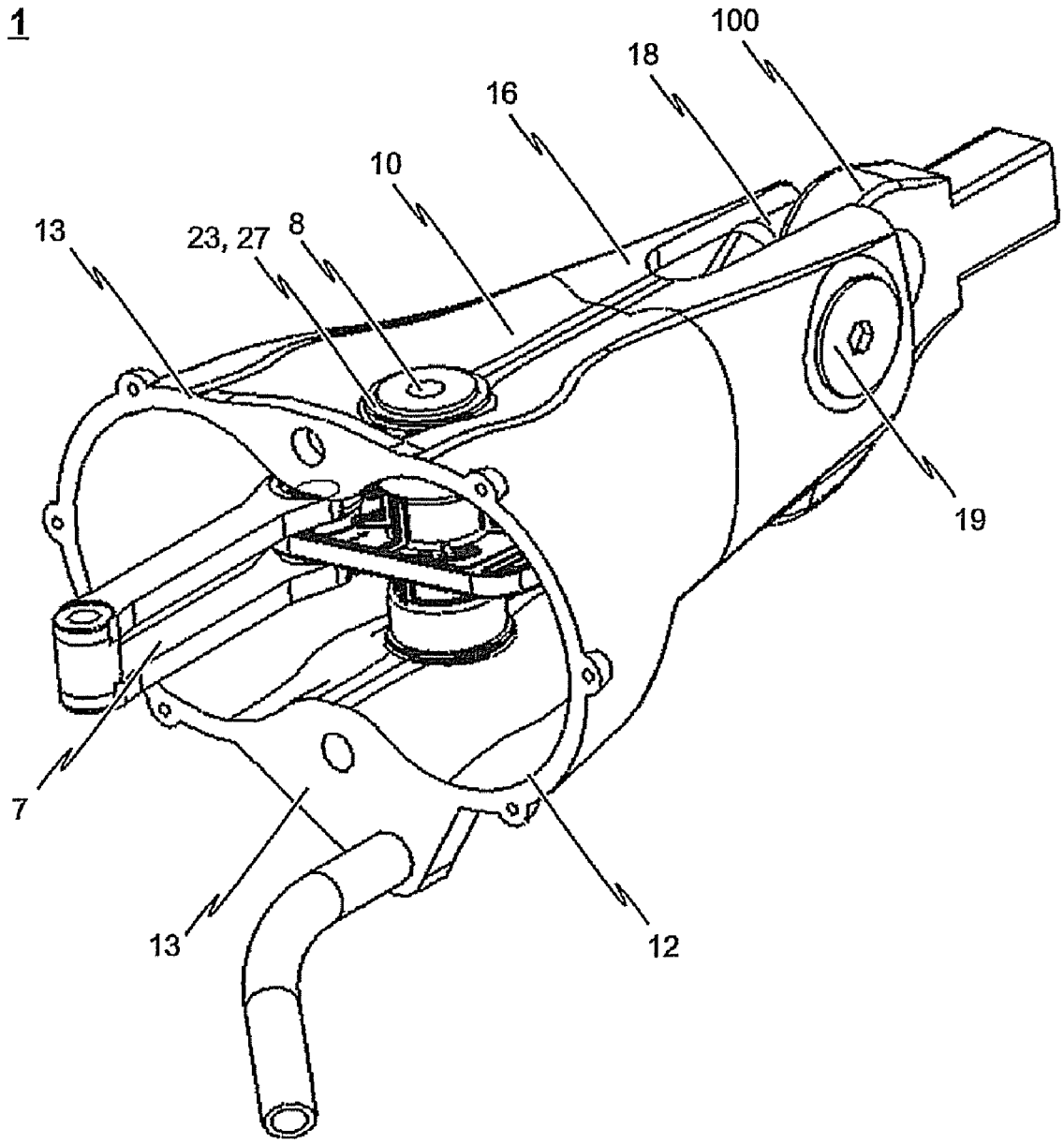
FIG. 1: a three-dimensional perspective view of an adapter coupler according to a first embodiment of the invention.

The embodiment of the inventive adapter coupler 1 depicted in the drawings is of light-weight construction and consists of a coupler housing 10 made from a fiber composite material. A coupling lock 5 is accommodated in the coupler housing 10 as a first connecting mechanism, serving the releasable connection of the adapter coupler 1 to the coupler head of an automatic central buffer coupling. Specifically, the adapter coupler 1 depicted in the drawings is designed to couple with an automatic central buffer coupling of the Scharfenberg® type.

The coupling lock 5 accommodated in the fiber composite coupler housing 10 comprises in particular a core piece 6 which is pivotably mounted relative the coupler housing 10 by means of a vertical main pin 8. A coupling grommet 7 is attached to the core piece 6 and serves to engage in a core piece of an automatic central buffer coupling to be coupled to the adapter coupler 1.

Although not explicitly depicted in the drawings, it is obviously conceivable for the coupling lock 5 to further comprise, additionally to the previously-cited core piece 6, which is pivotably mounted in the coupler housing 10 via the main pin 8 and to which the coupling grommet 7 is attached, tension springs, spring bearings and a ratchet rod with a punch guide so as to allow an automatic coupling and decoupling of the adapter coupler 1 with an automatic central buffer coupling of e.g. Scharfenberg® type. It is thus preferable for the coupling lock 5 accommodated in the coupler housing 10 to be configured as a conventional rotating lock and designed to be releasably connected mechanically to the coupler head of an automatic central buffer coupling.

In the embodiment of the inventive adapter coupler 1 depicted in the drawings, the core piece 6, the main pin 8 as well as the coupling grommet 7 are of metal construction (precision cast). In order to realize far less weight for the adapter coupler 1, it is of course conceivable for at least some of the components forming the coupling lock 5—such as the coupler housing 10—to be realized as a fiber composite construction.

Figure 7:
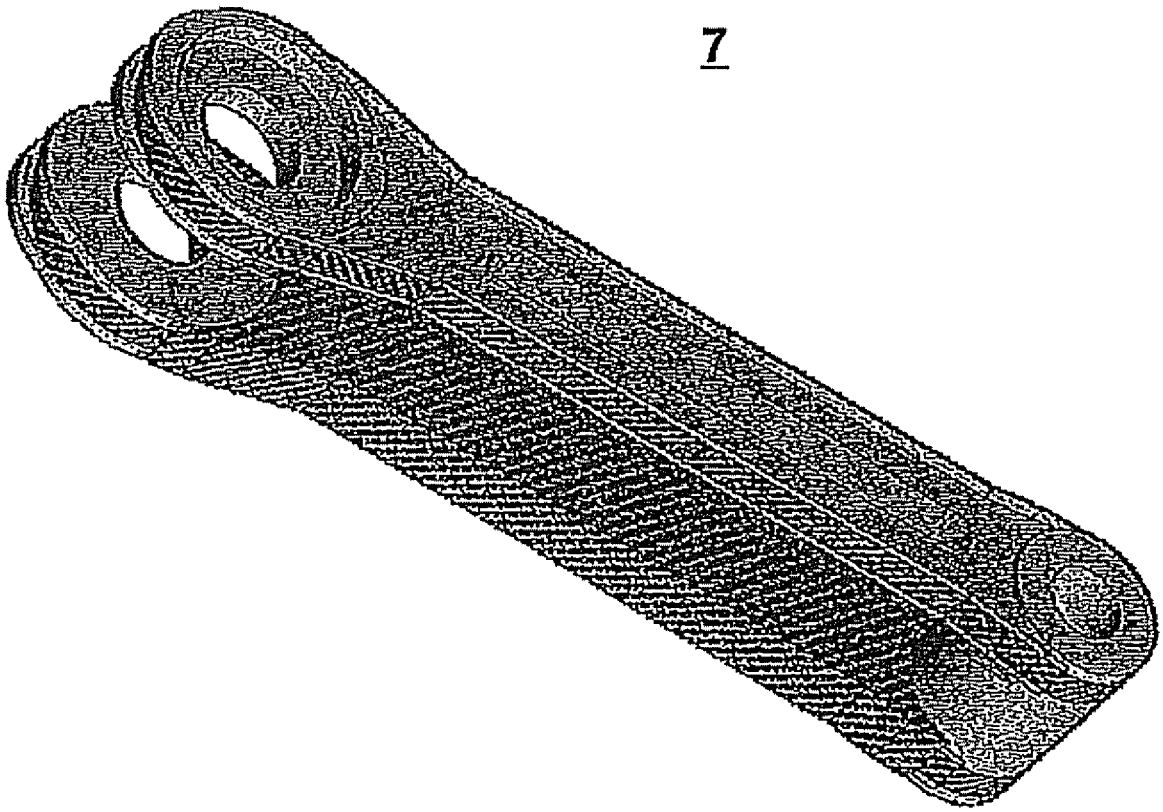
FIG. 7: an embodiment of a coupling grommet of hybrid construction for an embodiment of the adapter coupler according to the present invention.

For example, it is conceivable to configure the coupling grommet 7 as a hybrid construc-tion as can be inferred from the depiction of FIG. 7. In the case of the coupling grommet 7 depicted in FIG. 7, sections of said coupling grommet 7 serving to transmit tractive force to the core piece 6 of the coupling lock 5 are configured as inserts, for example metal inserts, while at least part of the middle section of said coupling grommet 7 is made from fiber composite material.

The coupling lock 5 accommodated in the coupler housing 10 serves to transmit traction load when the adapter coupler 1 is mechanically connected to the coupler head of an automatic central buffer coupling (not explicitly shown in the drawings). Compression load on the other hand is transmitted through the flat front face 11 of coupler housing 10. As can be noted from for example the depictions of FIGS. 1 and 2, the coupler housing 10 exhibits to this end a profile which consists of a wide, flat edge 13 as well as conical/funnel-shaped guide surfaces. This profile automatically aligns the adapter coupler 1 to an automatic central buffer coupling to be mechanically connected to the adapter coupler 1, centers it and allows sliding within one another even in tight curves and upon height displacements.

Figure 3A:
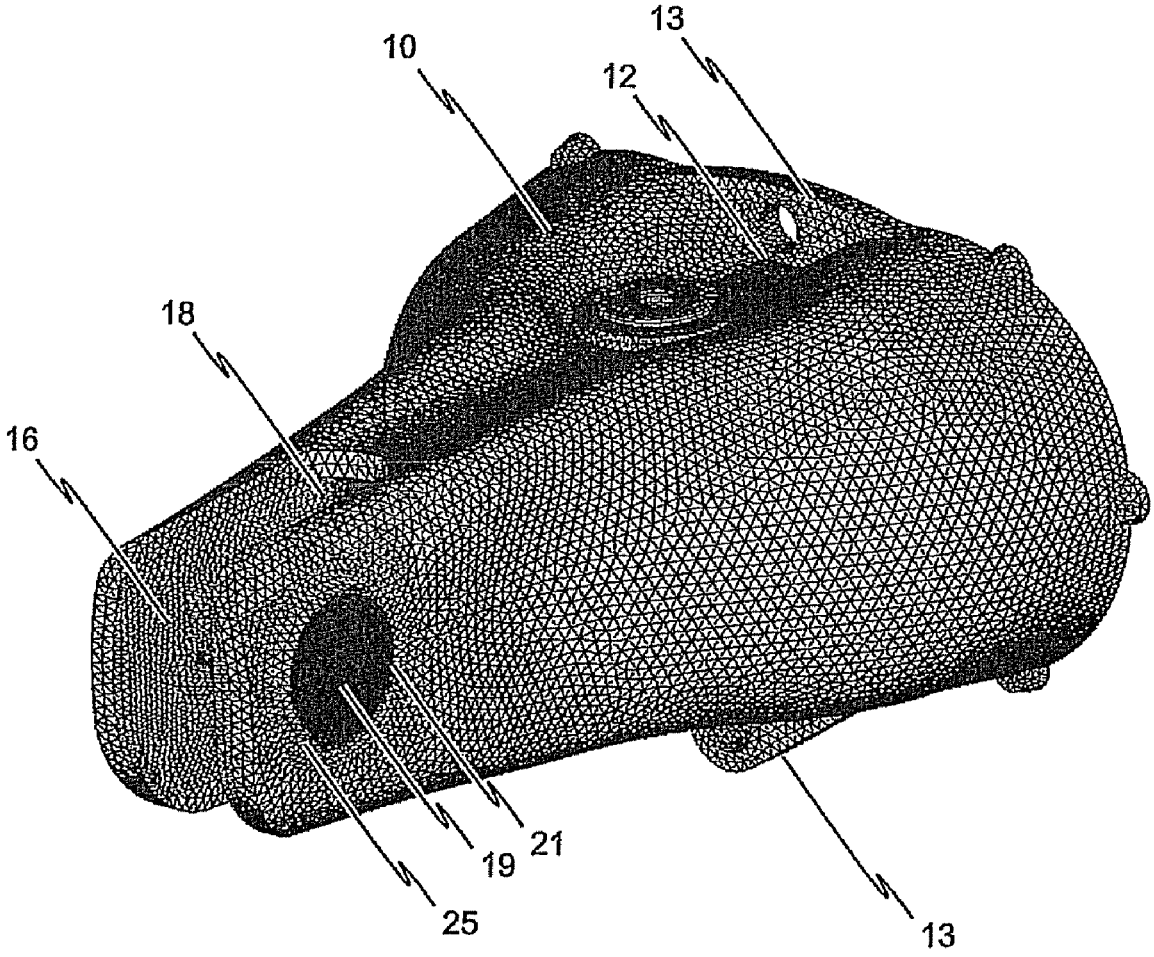
FIG. 3*a*: a three-dimensional perspective view of the rear of the coupler housing of the adapter coupler provided with inserts according to one embodiment of the present invention.
Figure 3B:
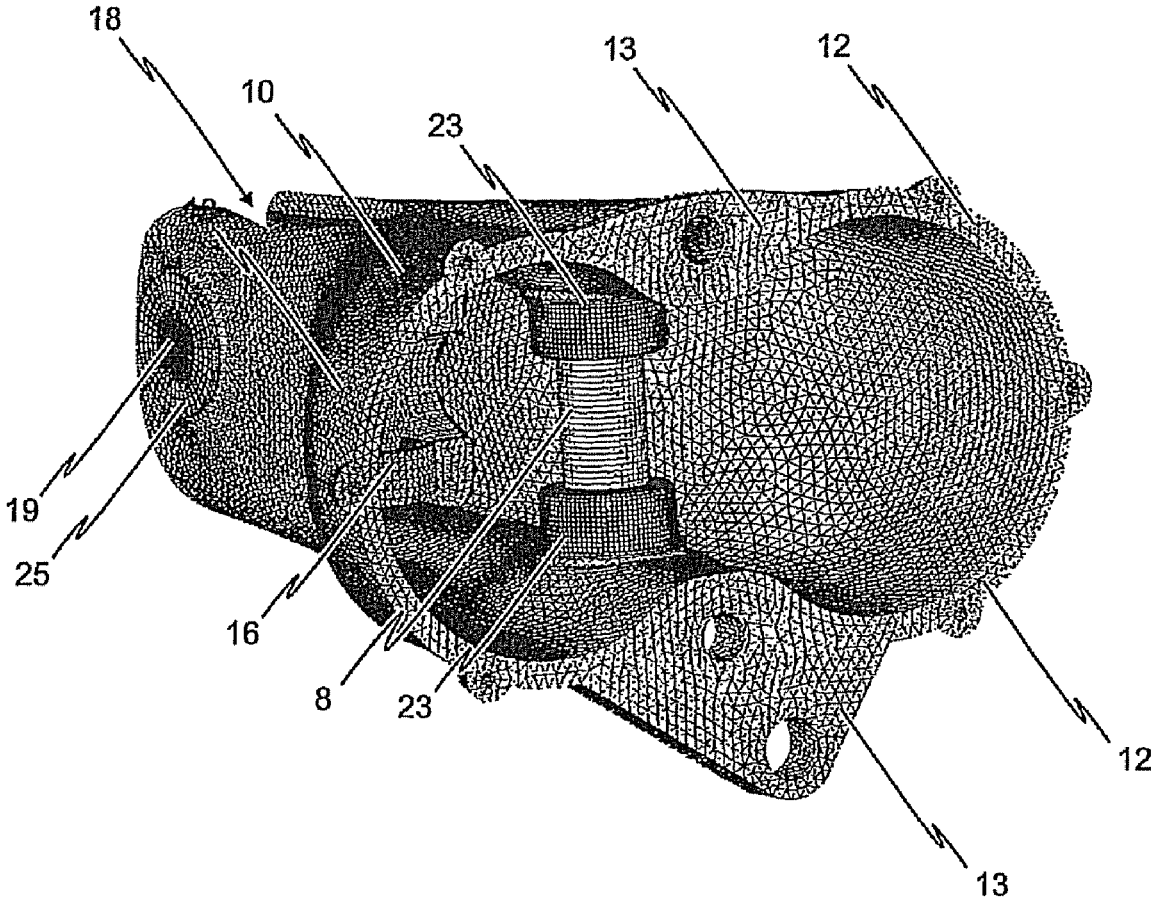
FIG. 3*b*: a three-dimensional perspective frontal view of the coupler housing according to FIG. 3*a;*
Figure 4:
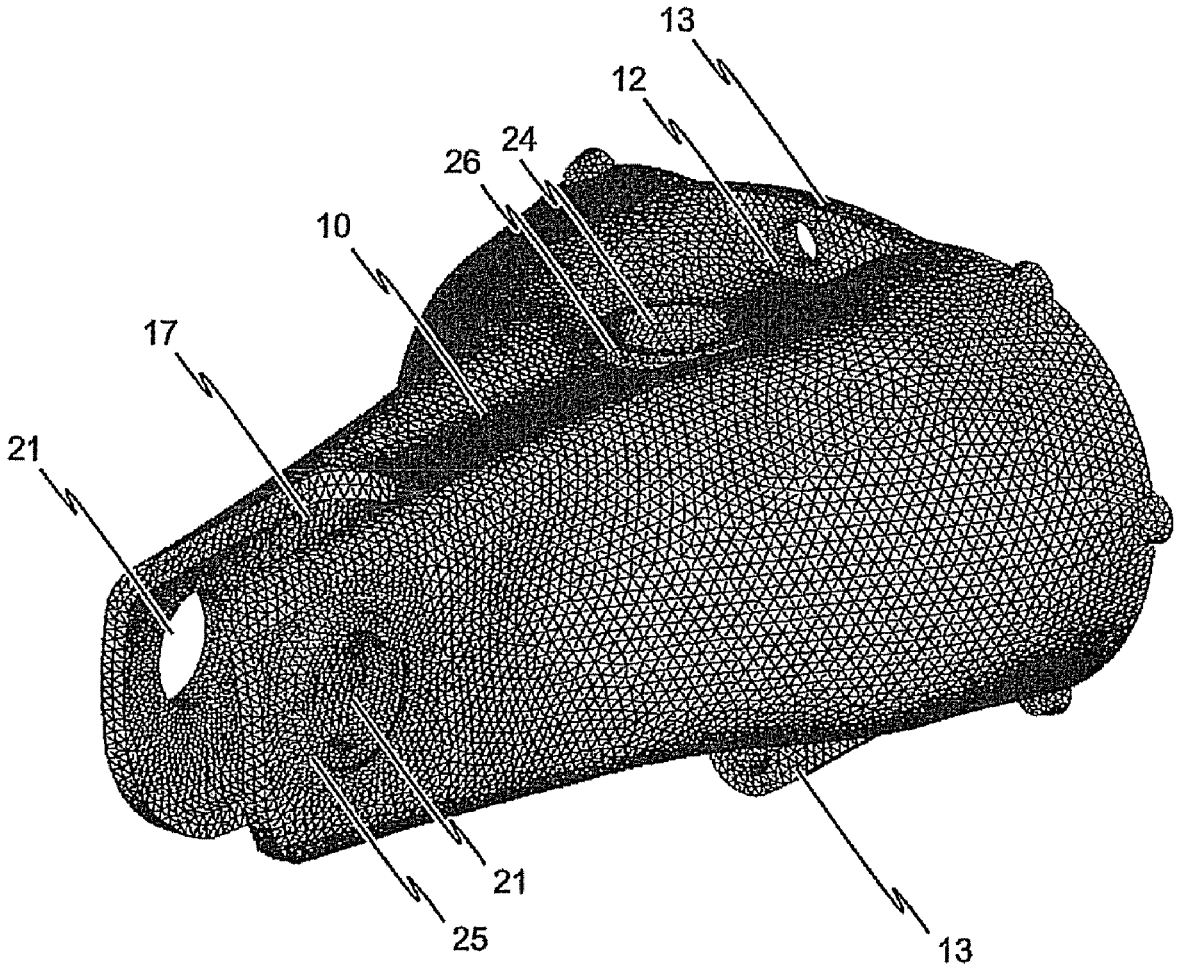
FIG. 4: a three-dimensional perspective view of the rear of the coupler housing of the adapter coupler according to one embodiment of the present invention without the inserts.

In detail, as shown in the FIG. 3*b* depiction, the front face 11 of the coupler housing 10 integrally-formed with said coupler housing 10 exhibits a broad, flat edge 13 to which a broad, flat collar 12 is additionally attached. Said additionally-provided collar 12 compared to a coupler housing of metal construction increases the contact area between the front face 11 of the fiber composite coupler housing 10 and the front face of a coupler head of an automatic central buffer coupling mechanically connected to the adapter coupler 1. The enlarged contact area thereby obtained prevents or reduces a concentration of the force flux vectors on the front face 11 of the coupler housing 10 during the transmission of compressive force.

Figure 2:
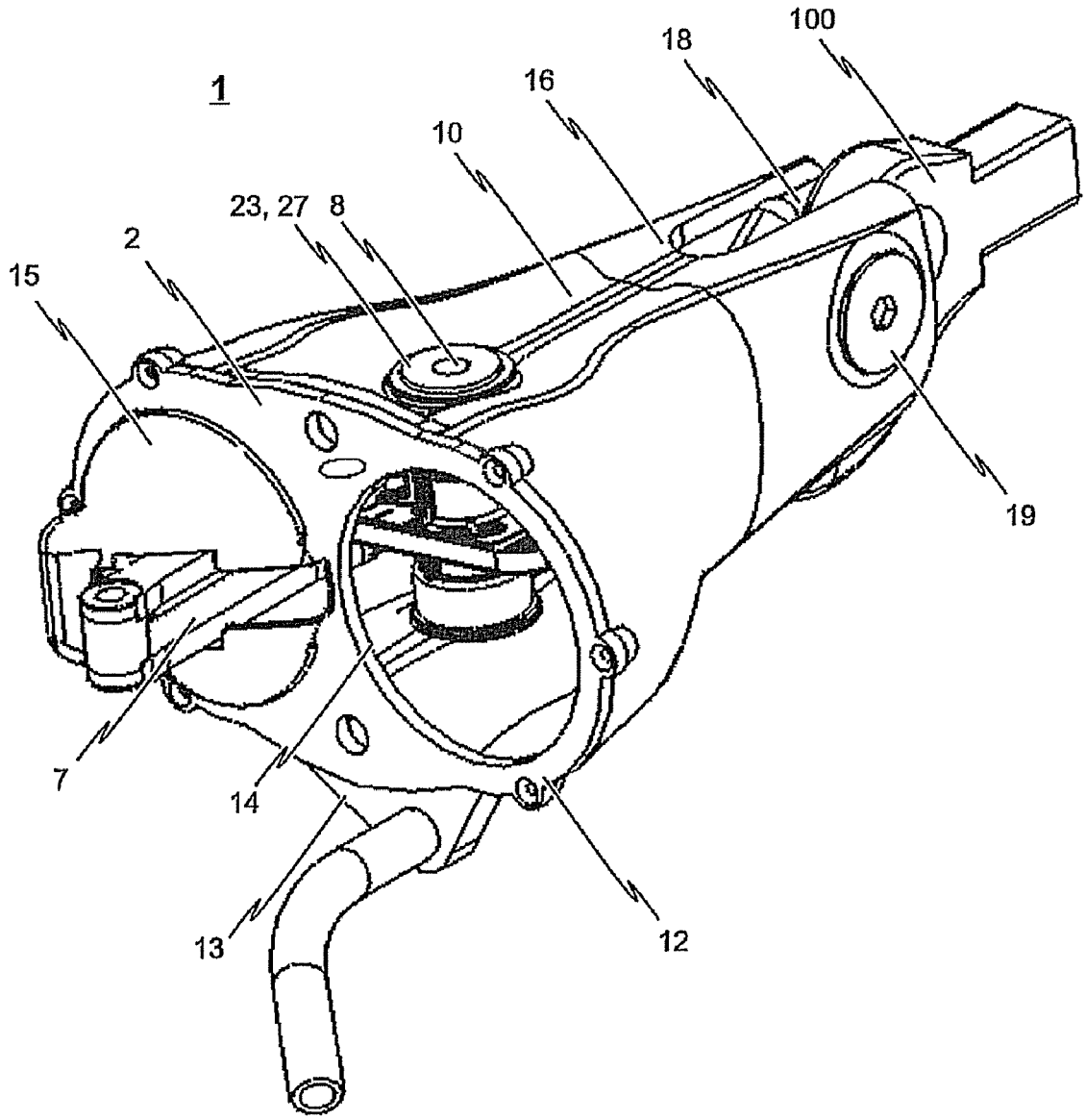
FIG. 2: a three-dimensional perspective view of a further embodiment of the adapter coupler according to the present invention.

Since—as already noted above—compressive forces are transmitted to the coupler housing of an automatic central buffer coupling mechanically connected to the adapter coupler 1 via the flat front face 11 and the additional collar 12 in the adapter coupler 1 according to the present invention, the FIG. 2 depiction of an advantageous embodiment of the inventive adapter coupler 1 shows a front plate 2 of metal configuration which is releasably connected to the front face 11 of the fiber composite coupler housing 10. The front plate 2 of metal configuration allows the compressive forces introduced into the coupler housing 10 of the adapter coupler 1 to be effectively distributed across a large surface so as to prevent a concentration of force flux vectors in the front face area of the coupler housing 10.

As can be noted especially from the FIG. 1 depiction, the fiber composite coupler housing 10 of the adapter coupler 1 can likewise comprise a front face 11 of fiber composite construction, configured integrally with the coupler housing 10. Said front face 11 preferably comprises a funnel 14 to receive a coupling grommet of an automatic central buffer coupling to be mechanically connected to the adapter coupler 1. Adjacent to the funnel 14 configured in the front face 11 of coupler housing 10, a cone 15 of fiber composite construction is further formed on the front face 11 of the coupler housing 10 in the FIG. 1 adapter coupler 1.

Thus, the front face 11 of the adapter coupler 1 exhibits a profile which is compatible with the profile of a coupler head of an automatic central buffer coupling.

As can be seen from the FIG. 3*a* depiction, a coupling yoke 16 is configured in the end section of the adapter coupler 1 opposite the front face 11 of the coupler housing 10 which is insertable into the drawhook 100 of a screw-type coupling for the releasable connection of the adapter coupler 1 to said screw-type coupling. To this end, the fiber composite coupler housing 10 comprises a recess 17 extending the longitudinal axis of the adapter coupler 1 on its end section opposite the front face 11. The coupling yoke 16 configured as an insert, for example a metal insert, is accommodated in this recess 17 and fixedly connected to the fiber composite material of the coupler housing 10, in particular by adhesive bond.

Figure 5A:
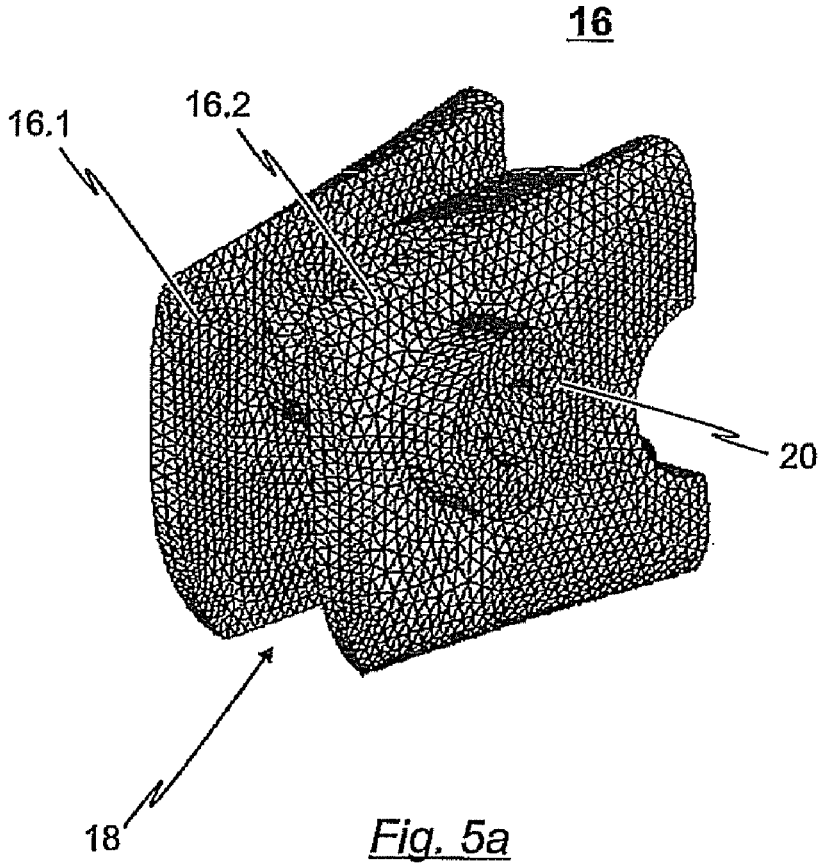
FIG. 5*a*: a three-dimensional perspective view of a coupling yoke configured as an insert for use in a coupler housing according to e.g.

The insert forming the coupling yoke 16, for example metal insert, is depicted separately in FIG. 5*a* and exhibits a U-shaped geometry in cross-section so that the insert component inserted into the recess forms a groove 18 extending the longitudinal axis of adapter coupler 1. As FIGS. 1 and 2 suggest, the drawhook 100 of a screw-type coupling can be inserted into said groove 18.

Alternatively to the insert forming the coupling yoke 16 depicted in FIG. 5*a*, it is also conceivable to form the coupling yoke from two support structures configured as inserts which are wholly made from CFP. Metal bushings can be integrated at the two ends into which pins are pressed in order to connect the two support structures together. These pins are thicker at their centers between the two support structures and are laterally flush with said support structures. Metal elements in the shape of half-shells can be attached (e.g. welded) to the side inclined toward the front face as impact protection.

Figure 5B:
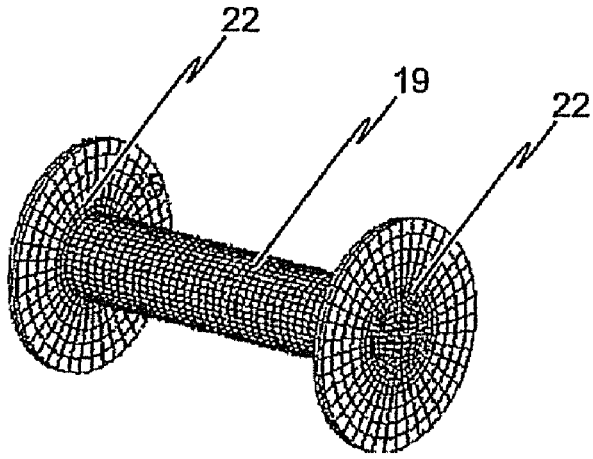
FIG. 5*b*: a three-dimensional perspective view of a drawhook pin for use in a coupler housing according to e.g.

The coupling yoke 16 configured at the rear end of adapter coupler 1 further comprises a drawhook pin 19 which bridges the groove 18 extending in the longitudinal direction of the adapter coupler 1 and connects together the limb sections 16.1, 16.2 of the coupling yoke 16 configured as an insert, for example a metal insert. FIG. 5*b* shows the drawhook pin 19 in a separate depiction. It is preferably of metal construction and can be fixedly connected to the coupling yoke 16 configured as an insert, for example a metal insert.

Conversely, with the adapter coupler 1 shown in the figures, the drawhook pin 19 on the one hand and the coupling yoke 16 configured as an insert, for example a metal insert, on the other, are each configured as a separate component.

By means of the coupling yoke 16 provided at the rear end of the adapter coupler 1 and then thereby connected drawhook pin 19, tractive and compressive forces occurring during the operation of the adapter coupler 1 are introduced from a drawhook 100 of a screw-type coupling into the fiber composite coupler housing 10, whereby the drawhook 100 of the screw-type coupling in inserted into the groove 18 configured at the rear end of the adapter coupler 1. In order to prevent force peaks when load is introduced into the fiber composite coupler housing 10, the limb sections 16.1, 16.2 of the coupling yoke 16 configured as an insert, for example a metal insert, are configured to be comparatively wide and materially bonded flush to the fiber composite material of the coupler housing 10.

It is hereby preferred for the recess 17 configured at the rear end of the fiber composite coupler housing 10 to exhibit a correspondingly rounded geometry in order to ensure the most continuous possible progression of the force flux vectors at the transition between the coupling yoke 16 configured as an insert, for example a metal insert, and the fiber composite material of the coupler housing 10.

The coupling yoke 16 configured as an insert, for example a metal insert, is—as noted above—materially connected via the surface of its limb sections 16.1, 16.2, in particular bonded, to the fiber composite material of the coupler housing 10. Additionally to this material connection, the embodiment of the inventive adapter coupler 1 as depicted further provides a positive connection. Specifically, sleeve-shaped elements 20 are formed or provided on the outer surfaces of each of the two limb sections 16.1, 16.2 of the coupling yoke 16 configured as an insert, for example a metal insert (cf. FIG. 5*a*). These sleeve-shaped elements 20 are each positively received in the respective horizontal drill hole 21 provided in the fiber composite coupler housing 10 (cf. FIG. 3*a*).

The above-cited drawhook pin 19 extends through the sleeve-shaped elements 20 of the coupling yoke 16 configured as an insert, for example a metal insert. The respective ends of the drawhook pin 19 are correspondingly secured by means of a reinforcement 22, a nut respectively, in order to prevent the drawhook pin 19 from falling out of the horizontal drill hole 21, respectively the sleeve-shaped elements 20 of the coupling yoke 16 accommodated in the horizontal drill hole 21.

Figure 6A:
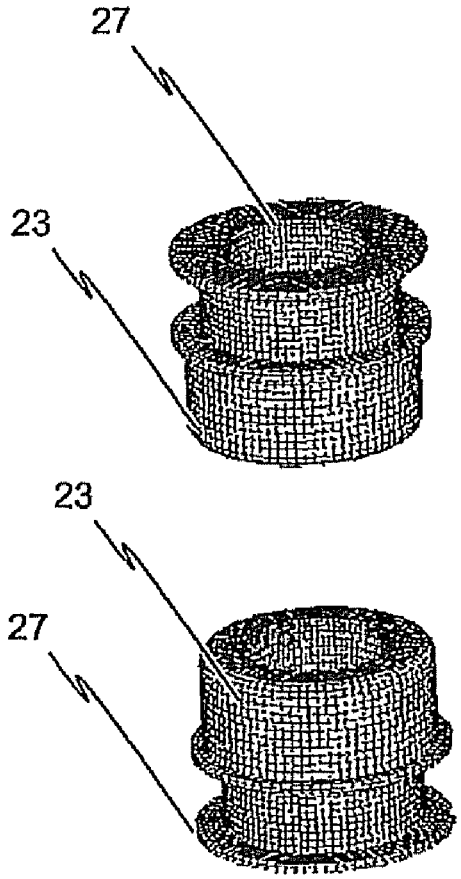
FIG. 6*a*: a three-dimensional perspective view from above and below of a sleeve-shaped element configured as an insert, for example a metal insert, for receiving a main pin in a coupler housing according to e.g.
Figure 6B:
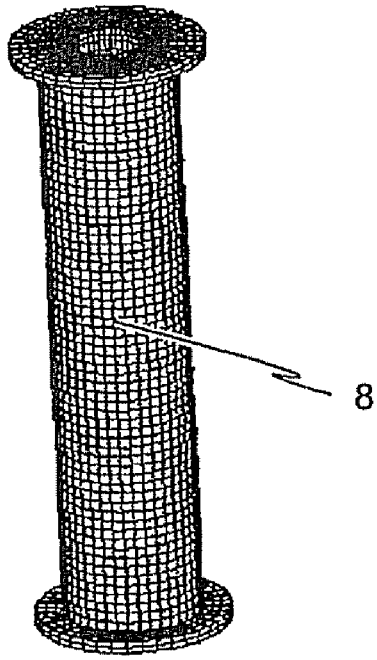
FIG. 6*b*: a three-dimensional perspective view of a main pin for use in a coupler housing according to e.g.

The vertical main pain 8 of the coupling lock 5, which allows the core piece 6 to rotate relative the coupler housing 10, is depicted separately in FIG. 6*b*. The main pin 8 is connected to the fiber composite coupler housing 10 in similar manner. Specifically, the sleeve-shaped elements 23 provided in the preferred embodiment of the inventive adapter coupler 1 depicted in the drawings are preferably of metal construction, through which the vertical main pin 8 of the coupling lock 5 is guided, and which are received in a vertical drill hole 24 in the fiber composite coupler housing 10. The sleeve-shaped elements 23 preferably configured as inserts, for example metal inserts, are depicted separately in FIG. 6*a*.

FIGS. 6*a* and 3*a* taken together directly reveal that the peripheral region of the drill hole 24 provided in the coupler housing 10 and extending in the longitudinal direction of the main pin 8 is preferably configured as a thickened section 26, whereby the sleeve-shaped elements 23 exhibit a outwardly-projecting collar 27 bearing on said thickened section 26.

What the use of the sleeve-shaped components 20 and 23 to accommodate the drawhook pin 19 and the main pin 6 achieves is that the forces transmitted to the fiber composite coupler housing 10 from the main pin 8, the drawhook pin 19 respectively, will be introduced over the largest surface area possible in the fiber composite material. Hence, force is introduced into the fiber composite material over the largest area possible so as to in particular prevent a concentration of force flux vectors at the points subject to application of force.

This effect is preferably reinforced in that—as suggested above—the peripheral regions of the drill holes 21, 24 provided in the fiber composite coupler housing 10 are correspondingly reinforced. These thickenings 25, 26 at the peripheral regions of the drill holes 21, 24 provided in the coupler housing 10 are preferably configured symmetrical to the points subject to application of force.

As can be noted from the depictions provided in FIGS. 1 and 2, the fiber composite coupler housing 10 exhibits an overall form adapted to a coupler housing 10 made of metal, albeit rounded. In this way, the geometrical dimensions of the inventive adapter coupler 1 correspond substantially to the dimensions of a conventional metal adapter coupler so as not to exceed the space requirements dictating the use of adapter coupler 1. The rounded form to the fiber composite coupler housing 10 serves to prevent sharp-edged bends, crimps, etc. It is thereby possible when forming the fiber composite coupler housing 10 to position the fibers along the expected force flux vectors, whereby abrupt sharp-edge changes in direction can be avoided. Such changes in direction lead to a notching effect of the fibers and to structural failure.

It is specifically provided for the fibers within the fiber composite coupler housing 10 to be positioned along previously-calculated force flux vectors so that said fibers are resistant to the forces to which they're subjected. Since positioning the fibers along pre-calculated force flux vectors can lead to three-dimensional fiber orientations, it is preferable to configure the wall of coupler housing 10 in layers and realize an optimized fiber orientation within each layer. Doing so thus realizes a specific fiber architecture designed to maintain the properties of the coupler housing 10 of the adapter coupler 1 which have been adapted to the expected loads. It is hereby preferable to select a quasi-isotopic fiber architecture, for example with fiber components of identical magnitude in the tensile and compressive direction.

In the design of the fiber composite coupler housing 10, it is preferable to employ carbon fibers in the form of continuous fibers. A so-called precursor is used to manufacture such continuous fibers; i.e. one starts with a high carbon content polymer, which can be spun relatively easily into continuous fibers, and which is then converted to a carbon fiber in a downstream pyrolysis step. Generally speaking, carbon fibers consist of continuous parallel filaments, also referred to in technical terms as "rovings."

Various different processes are in principle conceivable for manufacturing the coupler housing 10 configured from fiber composite material. However, particularly suited for manufacturing the coupler housing 10 is the so-called Tailored Fiber Placement (TFP) method in which the fibers are fix-stitched to flat substrates such as for example glass or carbon fiber textile material. Said fixing can be effected with various different sewing thread materials.

In detail, in manufacturing the fiber composite coupler housing 10, it is preferred to use the TFP method to position the carbon fibers in near net shape form along previously-calculated paths corresponding to the calculated force flux vectors. Although since the coupler housing 10 to be configured from fiber composite exhibits a relatively complex three-dimensional shape, approximating the shape of a coupler housing 10 made from metal, even the TFP process cannot avoid having the continuous carbon fibers being positioned with relative tight curve radii, in particular at the front and rear area of the coupler housing 10. At tight curve radii, rovings tend to tilt or rise upright in curved regions. Filaments at the inner curve of the positioned path would have to buckle or distend to the outer curve. However, the rigidity of the reinforcing fibers does not allow any longitudinal compensation relative the tensile and compressive strength of the filaments which would lead to a reduction in structural strength.

For this reason, it is preferred for the fiber composite coupler housing 10 to be formed as a winding body, wherein the continuous carbon fibers are laid down in loops. By force not being applied directly to the fiber composite coupler housing 10 in the inventive adapter coupler 1, but rather over relatively large inserts, for example metal inserts, 16, 20, 23, this effectively prevents load from being distributed over a large area where force is introduced and always diverted to a sufficient number of load-bearing fibers.

The invention is not limited to the embodiments of the adapter coupler 1 described above with reference to the drawings. Hence, it is for example also conceivable to realize further components of the adapter coupler 1 in addition to coupler housing 10 in fiber composite or hybrid construction. For example, a gripper can be configured on the front face 11 of the coupler housing 10, likewise of fiber composite construction and con-figured integrally with the fiber composite coupler housing 10.

On the other hand, it is also conceivable to configure the coupling grommet 7 of the coupling lock as a hybrid construction, wherein the areas of the coupling grommet 7 subject to force are configured as inserts, for example, metal inserts, while fiber composite is used for the remaining areas.

What is claimed is:

1. A transitional coupling for matching couplings of different types, wherein the transitional coupling comprises:

a first connecting mechanism for the releasable connecting of the transitional coupling to a first coupler;

a second connecting mechanism for the releasable connecting of the transitional coupling to a second coupler; and a coupler housing for connecting the first connecting mechanism to the second connecting mechanism, wherein the coupler housing (10) is formed from fiber composite material, in particular carbon fiber composite material, and has a sturdy fiber architecture resistant to the stress loads it experiences, wherein the second connecting mechanism is configured as an insert, wherein the coupler housing has a recess for accommodating the second connecting mechanism configured as an insert and fixedly connected to the fiber composite material of said coupler housing, wherein the first connecting mechanism comprises a coupling lock for the releasable connecting of the transitional coupling to the coupler head of a central buffer coupling, and wherein the second connecting mechanism comprises a coupling yoke to fit into the drawhook of a screw-type coupling or AAR coupling for the releasable connecting of the transitional coupling to the coupler head of a screw-type coupling or AAR coupling.

2. The transitional coupling according to claim 1, wherein an insert associated with the first connecting mechanism is provided which is accommodated in a recess provided in the coupler housing and fixedly connected to said coupler housing.

3. The transitional coupling according to claim 1, wherein the coupler housing exhibits a conical or funnel-shaped profile at a tapered end, on a horizontal plane, along a longitudinal axis, and is configured with a recess extending the longitudinal axis of the transitional coupling, and wherein a coupling yoke configured as an insert is received in said recess configured at the tapered end of the coupler housing and connected to said coupler housing.

4. The transitional coupling according to claim 1, wherein the coupling yoke configured as an insert comprises two substantially parallel limb sections fixedly connected to the coupler housing, and wherein a drawhook pin is further provided which connects the two limb sections of the coupling yoke configured as an insert together, preferably at their free end sections, and is designed to transmit tractive or compressive forces from the drawhook of a screw-type coupling or AAR coupling to the coupling yoke configured as an insert.

5. The transitional coupling according to claim 4, wherein the drawhook pin is configured separately from the coupling yoke configured as an insert and is accommodated in axial aligned drill holes provided in the two limb sections of the coupling yoke configured as an insert.

6. The transitional coupling according to claim 4, wherein the coupling yoke configured as an insert comprises two sleeve-shaped elements axially aligned with the drill holes configured in the two limb sections of the coupling yoke configured as an insert, and which are received in a horizontal drill hole configured in the coupler housing, wherein the draw-hook pin runs through the two sleeve-shaped elements of the coupling yoke and through the horizontal drill hole provided in the coupler housing .

7. The transitional coupling according to claim 6, wherein a peripheral area of the drill hole running through the coupler housing is configured as a thickened area.

8. The transitional coupling according to claim 1, wherein the coupling lock comprises a core piece with attached coupling eye pivotable relative the coupler housing by means of a vertically-extending main pin, and wherein an upper and/or lower end section of the main pin is/are respectively mounted in a sleeve-shaped element configured as an insert, wherein the sleeve-shaped elements configured as an insert are set in a drill hole provided in the coupler housing and extending in a longitudinal direction of the main pin and fixedly connected to said coupler housing.

9. The transitional coupling according to claim 8, wherein a peripheral area of the drill hole provided in the coupler housing and extending in the longitudinal direction of the main pin is configured as a thickened area, and wherein the sleeve-shaped element exhibits a outwardly-projecting collar bearing on said thickened area.

10. The transitional coupling according to claim 1, wherein the coupler housing exhibits a front face at the first and/or second connecting mechanism having a broad, flat edge and a collar additionally attached to said edge.

11. The transitional coupling according to claim 10, further comprising a front plate, in particular a front plate of metal configuration, which is releasably connected to the front face of the coupler housing.

12. An adapter coupler for adapting couplings of different design, wherein the adapter coupler comprises:

a first connecting mechanism for the releasable connecting of the adapter coupler to a first coupler;

a second connecting mechanism for the releasable connecting of the adapter coupler to a second coupler; and a coupler housing to connect the first connecting mechanism to the second connecting mechanism, wherein the coupler housing is formed from fiber composite material, in particular carbon fiber composite material, wherein the coupler housing has a sturdy fiber architecture resistant to the stress loads it experiences;

wherein to introduce tractive and compressive forces into the coupler housing, the first connecting mechanism and/or second connecting mechanism is designed as an insert and accommodated in the coupler housing and fixedly connected to said coupler housing;

wherein the first connecting mechanism has a coupling lock for the releasable connecting of the adapter coupler to the coupler head of a central buffer coupling, and wherein the second connecting mechanism has a coupling yoke insertable into the drawhook of a screw-type coupling or AAR coupling for the releasable connecting of the adapter coupler to the coupler head of a screw-type coupling or AAR coupling;

wherein the coupler housing exhibits a conical or funnel-shaped profile at a tapered end, on a horizontal plane, along a longitudinal axis and is configured with a recess extending the longitudinal axis of the adapter coupler, and wherein a coupling yoke configured as an insert is received in said recess configured at the tapered end of the coupler housing and connected to said coupler housing.

13. The adapter coupler according to claim 12, wherein the coupling yoke configured as an insert comprises two substantially parallel limb sections fixedly connected in alignment with the coupler housing, and wherein a drawhook pin is further provided which connects the two limb sections of the coupling yoke configured as an insert together, preferably at their free end sections, and is designed to transmit tractive or compressive forces from the drawhook of a screw-type Coupling or AAR coupling to the coupling yoke (16) configured as an insert.

14. The adapter coupler according to claim 13, wherein the drawhook pin is configured separately from the coupling yoke configured as an insert and accommodated in axial alignment in drill holes provided in the two limb sections of the coupling yoke configured as an insert.

15. The adapter coupler according to claim 14, wherein the coupling yoke configured as an insert comprises two sleeve-shaped elements axially aligned with the drill holes configured in the two limb sections of the coupling yoke configured as an insert, and which are received in a horizontal drill hole configured in the coupler housing, wherein the draw-hook pin runs through the two sleeve-shaped elements of the coupling yoke and through the horizontal drill hole provided in the coupler housing.

16. The adapter coupler according to claim 15, wherein the drill hole running through the coupler housing has a peripheral region, and wherein the peripheral region of the drill hole is configured as a thickened section.

17. The adapter coupler according to claim 12, wherein the coupling lock comprises a core piece with attached coupling grommet pivotable relative the coupler housing by means of a vertically-extending main pin, and wherein an upper and/or lower end section of the main pin is/are respectively mounted in a sleeve-shaped element configured as an insert, wherein the sleeve-shaped elements configured as an insert are set in a drill hole provided in the coupler housing and extend in a longitudinal direction of the main pin and are fixedly connected to said coupler housing.

18. The adapter coupler according to claim 17, wherein a peripheral region of the drill hole provided in the coupler housing and extending in the longitudinal direction of the main pin is configured as a thickened section, and wherein the sleeve-shaped element exhibits a outwardly-projecting collar bearing on said thickened section.

19. The adapter coupler according to claim 12, wherein the coupler housing exhibits a front face at the first and/or second connecting mechanism having a broad, flat edge and a collar additionally attached to said edge.

20. The adapter coupler according to claim 19, further comprising a front plate, in particular a front plate of metal configuration, which is releasably connected to the front face of the coupler housing.

21. The adapter coupler according to claim 19, wherein a funnel to receive a coupling grommet of an automatic central buffer coupling is configured in the front face of the coupler housing and, spaced at a distance from said funnel, a cone made of fiber composite material.

22. The adapter coupler according to claim 12, wherein the coupler housing is at least partly formed as a winding body.

23. An adapter coupler for adapting couplings of different design, wherein the adapter coupler comprises:

a first connecting mechanism for the releasable connecting of the adapter coupler to a first coupler;

a second connecting mechanism for the releasable connecting of the adapter coupler to a second coupler; and a coupler housing to connect the first connecting mechanism to the second connecting mechanism, wherein the coupler housing is formed from fiber composite material, in particular carbon fiber composite material, wherein the coupler housing has a sturdy fiber architecture resistant to the stress loads it experiences;

wherein to introduce tractive and compressive forces into the coupler housing, the first connecting mechanism and/or second connecting mechanism is designed as an insert and accommodated in the coupler housing and fixedly connected to said coupler housing;

wherein the first connecting mechanism has a coupling lock for the releasable connecting of the adapter coupler to the coupler head of a central buffer coupling, and wherein the second connecting mechanism has a coupling yoke insertable into the drawhook of a screw-type coupling or AAR coupling for the releasable connecting of the adapter coupler to the coupler head of a screw-type coupling or AAR coupling;

wherein the coupling yoke configured as an insert comprises two substantially parallel limb sections fixedly connected in alignment with the coupler housing, and wherein a drawhook pin is further provided which connects the two limb sections of the coupling yoke configured as an insert together, preferably at their free end sections, and is designed to transmit tractive or compressive forces from the drawhook of a screw-type Coupling or AAR coupling to the coupling yoke configured as an insert;

wherein the drawhook pin is configured separately from the coupling yoke configured as an insert and accommodated in axial alignment in drill holes provided in the two limb sections of the coupling yoke configured as an insert;

wherein the coupling yoke configured as an insert comprises two sleeve-shaped elements axially aligned with the drill holes configured in the two limb sections of the coupling yoke configured as an insert, and which are received in a horizontal drill hole configured in the coupler housing, wherein the draw-hook pin runs through the two sleeve-shaped elements of the coupling yoke and through the horizontal drill hole provided in the coupler housing.

24. The adapter coupler according to claim 23, wherein the drill hole running through the coupler housing has a peripheral region, and wherein the peripheral region of the drill hole is configured as a thickened section.

25. The adapter coupler according to claim 23, wherein the coupling lock comprises a core piece with attached coupling grommet pivotable relative the coupler housing by means of a vertically-extending main pin, and wherein an upper and/or lower end section of the main pin is/are respectively mounted in a sleeve-shaped element configured as an insert, wherein the sleeve-shaped elements configured as an insert are set in a drill hole provided in the coupler housing and extend in a longitudinal direction of the main pin and are fixedly connected to said coupler housing.

26. The adapter coupler according to claim 25, wherein a peripheral region of the drill hole provided in the coupler housing and extending in the longitudinal direction of the main pin is configured as a thickened section, and wherein the sleeve-shaped element exhibits a outwardly-projecting collar bearing on said thickened section.

27. The adapter coupler according to claim 23, wherein the coupler housing exhibits a front face at the first and/or second connecting mechanism having a broad, flat edge and a collar additionally attached to said edge.

28. The adapter coupler according to claim 27, further comprising a front plate, in particular a front plate of metal configuration, which is releasably connected to the front face of the coupler housing.

29. The adapter coupler according to claim 27, wherein a funnel to receive a coupling grommet of an automatic central buffer coupling is configured in the front face of the coupler housing and, spaced at a distance from said funnel, a cone made of fiber composite material.

30. The adapter coupler according to claim 23, wherein the coupler housing is at least partly formed as a winding body.

31. An adapter coupler for adapting couplings of different design, wherein the adapter coupler comprises:

a first connecting mechanism for the releasable connecting of the adapter coupler to a first coupler;

a second connecting mechanism for the releasable connecting of the adapter coupler to a second coupler; and a coupler housing to connect the first connecting mechanism to the second connecting mechanism, wherein the coupler housing is formed from fiber composite material, in particular carbon fiber composite material, wherein the coupler housing has a sturdy fiber architecture resistant to the stress loads it experiences;

wherein to introduce tractive and compressive forces into the coupler housing, the first connecting mechanism and/or second connecting mechanism is designed as an insert and accommodated in the coupler housing and fixedly connected to said coupler housing;

wherein the first connecting mechanism has a coupling lock for the releasable connecting of the adapter coupler to the coupler head of a central buffer coupling, and wherein the second connecting mechanism has a coupling yoke insertable into the drawhook of a screw-type coupling or AAR coupling for the releasable connecting of the adapter coupler to the coupler head of a screw-type coupling or AAR coupling;

wherein the coupling lock comprises a core piece with attached coupling grommet pivotable relative the coupler housing by means of a vertically-extending main pin, and wherein an upper and/or lower end section of the main pin is/are respectively mounted in a sleeve-shaped element configured as an insert, wherein the sleeve-shaped elements configured as an insert are set in a drill hole provided in the coupler housing and extend in a longitudinal direction of the main pin and are fixedly connected to said coupler housing.

32. The adapter coupler according to claim 31, wherein a peripheral region of the drill hole provided in the coupler housing and extending in the longitudinal direction of the main pin is configured as a thickened section, and wherein the sleeve-shaped element exhibits a outwardly-projecting collar bearing on said thickened section.

* * * * *